US011338281B2

(12) United States Patent
Link et al.

(10) Patent No.: US 11,338,281 B2
(45) Date of Patent: May 24, 2022

(54) PIPETTING DEVICE AND METHOD FOR PRODUCING SAME

(71) Applicant: EPPENDORF AG, Hamburg (DE)

(72) Inventors: Holger Link, Hamburg (DE); Tobias David, Bargteheide (DE); Hedda Merkens, Hamburg (DE)

( * ) Notice: Subject to any disclaimer, the term of this patent is extended or adjusted under 35 U.S.C. 154(b) by 409 days.

(21) Appl. No.: 16/065,628

(22) PCT Filed: Dec. 21, 2016

(86) PCT No.: PCT/EP2016/082131

§ 371 (c)(1),
(2) Date: Jun. 22, 2018

(87) PCT Pub. No.: WO2017/108921

PCT Pub. Date: Jun. 29, 2017

(65) Prior Publication Data

US 2020/0246788 A1 Aug. 6, 2020

(30) Foreign Application Priority Data

Dec. 22, 2015 (DE) ..... 10 2015 016 603.4

(51) Int. Cl.
*B01L 3/02* (2006.01)

(52) U.S. Cl.
CPC ..... *B01L 3/0213* (2013.01); *B01L 2400/0487* (2013.01); *B01L 2400/065* (2013.01)

(58) Field of Classification Search
CPC ..... B01L 3/0213; B01L 2400/0487; B01L 2400/065; B01L 2400/049
See application file for complete search history.

(56) References Cited

U.S. PATENT DOCUMENTS 3,963,061 A 6/1976 Kenney et al.
5,294,405 A 3/1994 Kenney et al.
(Continued)

FOREIGN PATENT DOCUMENTS

CN 101566179 A 10/2009
JP 1996/192761 7/1996
(Continued)

*Primary Examiner* — Christopher Adam Hixson
(74) *Attorney, Agent, or Firm* — Todd Lorenz

(57) ABSTRACT

The invention further relates to a method for producing said pipetting device. The invention relates to a pipetting device, in particular for pipetting a fluid sample by suctioning into a pipetting container using air under a pipetting pressure, having the following: —a valve assembly with at least one valve device for adjusting a pipetting pressure, said valve device having a valve chamber; —at least one pump device which is connected to the valve chamber in order to generate a chamber pressure in the valve chamber; —a pipetting channel which is connected to the pipetting container, and—a bypass channel which is open towards the surroundings, wherein—the pipetting channel and the bypass channel are each connected to the valve chamber; and—the at least one valve device has a closure element with a closure surface which is designed such that the chamber pressure is distributed to the pipetting channel and the bypass channel in a metered manner by the valve device in order to generate the desired pipetting pressure in the pipetting channel. The invention further relates to a method for producing said pipetting device.

12 Claims, 4 Drawing Sheets

(56) References Cited

U.S. PATENT DOCUMENTS

Figure 1:
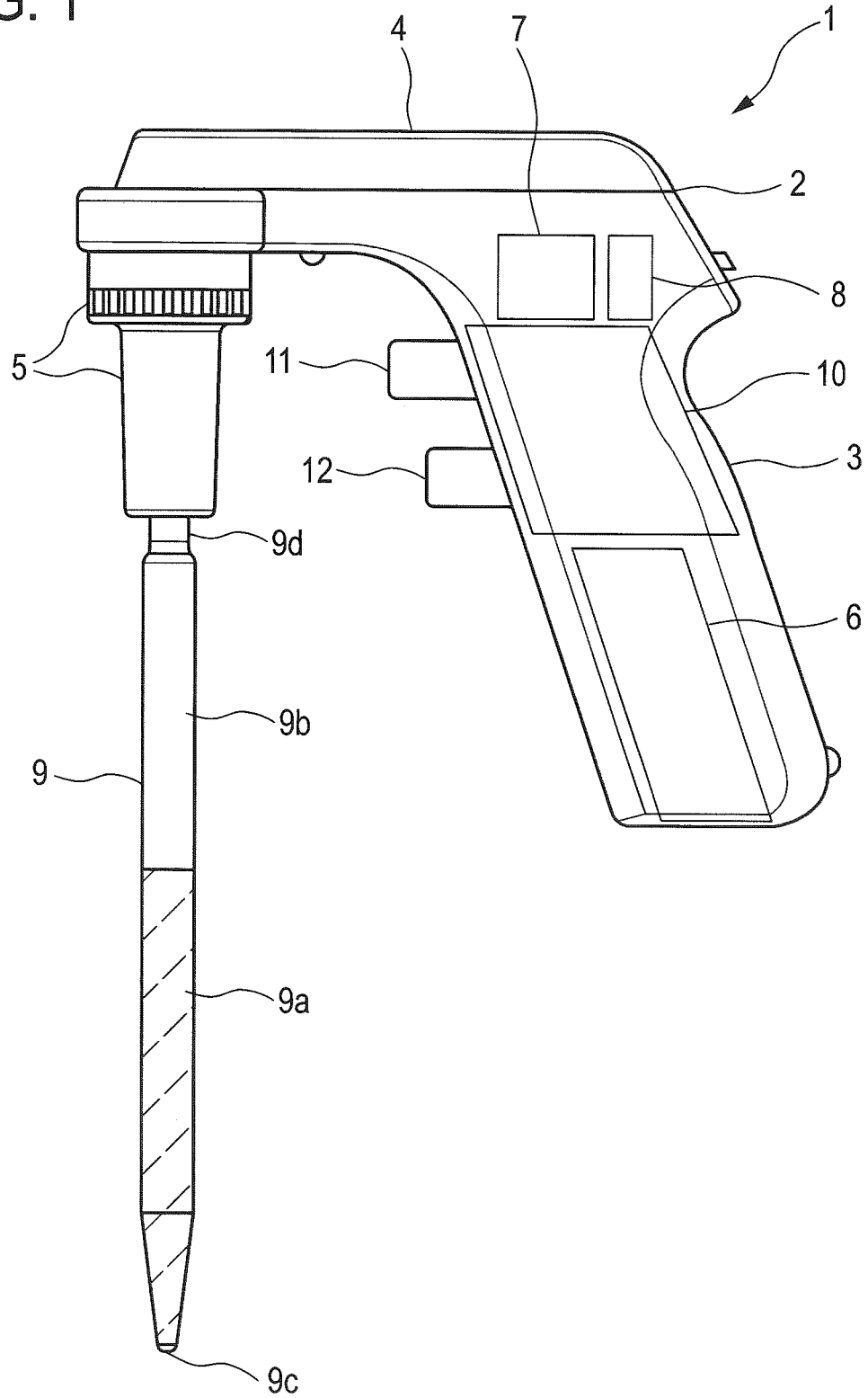

| | | | | |
|---|---|---|---|---|
| 6,253,628 | B1 | 7/2001 | Steele et al. | |
| 2003/0019305 | A1 | 1/2003 | Richter et al. | |
| 2004/0241022 | A1 | 12/2004 | Becker et al. | |
| 2013/0243666 | A1* | 9/2013 | Link | B01L 3/0213 422/522 |

FOREIGN PATENT DOCUMENTS

| | | | |
|---|---|---|---|
| JP | 1999/051208 | | 2/1999 |
| WO | WO 1993/21509 | A1 | 10/1993 |
| WO | WO 2013/045711 | A1 | 4/2013 |

* cited by examiner

PIPETTING DEVICE AND METHOD FOR PRODUCING SAME

The invention relates to a pipetting apparatus and a method for producing said pipetting apparatus.

Such pipetting apparatus are usually used in medical, biological, biochemical, chemical and other types of laboratories. They serve in the laboratory for transporting and transferring fluid samples, in particular in the precise dosing of the samples. With pipetting apparatus, fluid samples are for example suctioned into a pipetting container, e.g. a graduated pipette, by means of negative pressure, stored there, and then dispensed from same again at the target location.

Pipetting apparatus include, for example, hand-held pipetting apparatus or automatically controlled pipetting apparatus, in particular computer-controlled pipettors. These normally take the form of air-cushion pipetting apparatus, meaning an air cushion is provided, the pressure of which is reduced when the sample is taken up into the pipetting container, whereby the sample is suctioned into the pipetting container by means of negative pressure. Such pipetting apparatus are usually electrically operated devices, also called pipette controllers.

Such pipetting apparatus are usually designed to pipette fluid sample volumes ranging from e.g. 0.1 ml to 100 ml. Most such pipetting apparatus have an electrically driven pump, historically a diaphragm pump suitable for pipetting, which can thus generate both a negative pressure as well as a positive pressure. The term "pipetting" here encompasses both the taking up of a sample by suctioning under negative pressure as well as the dispensing of the sample by means of gravity and/or a squeezing out under positive pressure. A suction/pressure line is usually used in pipetting, the action of which an operator can control by means of suitable valves in the housing body.

One example of a commercially available, hand-held, electrical pipetting apparatus is the Eppendorf Easypet® 3 from Eppendorf AG, Hamburg, Germany.

For better dosing of the pipette fluid volume, apparatus are known which limit the flow rate in the pressure/suction lines or accordingly adapt the output or respectively pressure of the pump.

Valves which are to limit the flow rate in the pressure/suction lines are described in U.S. Pat. Nos. 3,963,061 and 6,253,628. The valve needle thereby has a profile which varies the free passageway in the pressure/suction line depending on the lift of the valve needle. Such systems can only inadequately achieve exact dosing, particularly in the case of low-volume pipettes. Particularly during restricted pump output, it is clearly seen that dosing is greatly dependent on the stroke frequency of the pump. Despite throttled flow rate, the pulsations of the pump continue on into the pipette and thus provide for intermittent dosing of the fluid. Maintaining an exact volume is thereby difficult to achieve.

The DE 103 22 797 patent describes an assembly in which in addition to the throttle elements in the pressure and suction line, there are likewise separately throttled openings to the surroundings. These are directly connected to the pressure/suction line and are to restrict the pump's maximum positive/negative pressure to a defined value. Thus, this assembly is highly limited in terms of variability. Before pipetting, the user must carefully consider which throttle setting needs to be made for the respective volume of fluid.

One task of the invention is that of providing a pipetting apparatus which allows precise pipetting and dosing, in particular independent of pipetting container size. A further task of the invention is that of specifying a method for producing said pipetting apparatus.

The invention solves this task by the pipetting apparatus according to claim 1. Preferential embodiments constitute in particular the subject matter of the subclaims.

The pipetting apparatus, in particular for pipetting a fluid sample by suctioning into a pipetting container using air under a pipetting pressure, comprises:

- a valve assembly having at least one valve device for adjusting a pipetting pressure, wherein the valve device comprises at least one valve chamber;
- at least one pump device connected to at least one valve chamber in order to generate at least one chamber pressure in said valve chamber;
- a pipetting channel which is connectable to the pipetting container and
- a bypass channel which is open to the surroundings;
- wherein preferably the pipetting channel and the bypass channel are each connected to the valve chamber and in particular connected to the valve chamber parallel to each other;
- wherein the valve chamber has a first chamber opening connected to the pipetting channel and a second chamber opening connected to the bypass channel,
- wherein the valve device comprises a closure element at least partially disposed within the valve chamber which can be moved relative to the valve chamber by a user-controlled movement and has at least one closure surface which slides along said chamber openings parallel to the first and parallel to the second chamber opening during the movement and controls their closed state as a function of the position of the closure surface, and
- wherein the at least one closure surface is formed such that in order to generate the desired pipetting pressure in the pipetting channel, the chamber pressure is distributed to the pipetting channel and the bypass channel as a function of the position of the at least one closure surface at the first and second chamber opening.

The advantage of the invention lies in enabling an exact dosing of the pipetting volume in dependence on the relationship between the closed states of the first and second chamber opening. The closed state can in each case be: fully open, completely closed or partly closed.

By means of the bypass created, fluctuations in the pumping pressure (negative pressure and/or positive pressure) during dosing do not continue substantially in full into the pipetting container connected to the pipetting channel, particularly not at low pumping capacity. In the case of a pump device designed as a diaphragm pump, particularly the pulsations caused by the diaphragm movement do not continue substantially in full into the pipetting container. In the optional case of the pump device at full pumping capacity, even pipetting containers of low pipetting volume (e.g. <5 mL) can in particular be very exactingly filled. The same applies analogously to the dispensing of the fluid sample from the pipetting container.

The closure surface is preferably a substantially planar surface lying in one plane, and the first and/or the second chamber opening or a sealing section connected to said chamber opening preferably comprises a respective opening edge lying substantially in the same plane or bordering same. This thereby enables the closure surface in contact with the respective chamber opening and/or its sealing section to be able to slide along the respective chamber opening and/or its sealing section through the user-controlled movement. The contact is preferably such that in the closed state of closure, the respective chamber opening achieves a gas-tight sealing contact so that particularly in the case of a fully closed second chamber opening, the chamber pressure substantially fully dictates the pipetting pressure without pressure loss through the second chamber opening, and so that further particularly in the case of a fully closed first chamber opening, the chamber pressure has substantially no effect on the pipetting pressure since the chamber pressure is being applied to the second chamber opening, and thus the bypass channel, whereby the pump device is preferably deactivated and/or does not affect the pressure of the valve chamber in this position of the closure element.

The closure surface can, however, also have a non-planar shape, in particular a cylindrical form, which can be mathematically described by translating a circular shape, or another shape which can be mathematically described by translating or rotating another shape, whereby such other shape can be, for example, an ellipse, a triangle, a square, a pentagon, a hexagon or other polygon. The chamber openings or their sealing sections respectively are then accordingly shaped such that at least a sectionally complete closure of the first and/or second chamber opening is/are achieved during the movement.

Preferably provided is for the closure element to comprise at least one recess which extends from the closure surface into the depth of the closure element and forms at least one closure surface opening in the closure surface, wherein this at least one closure surface opening has a length measured parallel to the direction of movement and a width measured perpendicular thereto, wherein the width of the at least one closure surface opening and/or the depth of the at least one recess varies at least sectionally in the direction of movement, and in particular the closure surface with the at least one closure surface opening slides along the first and/or second chamber opening such that the closure cross section of the first and/or second chamber opening varies during the movement.

The varying of the shape of the recess, in particular the width and/or depth, along the direction of movement—in particular at a constant predefined chamber pressure or pumping capacity—enables the flow resistance through the connecting channel to be adjusted, whereby the connecting channel signifies the flow sections located between the valve chamber and the pipetting channel ("first connecting channel") or, respectively, the flow sections located between the valve chamber and the bypass channel ("second connecting channel"). The closure surface opening located in the closure surface can in particular exhibit a tapering or widening progression in the direction of movement and can in particular be triangular. The progression can, however, also be trapezoidal or rectangular.

Instead of a recess, the closure element can also comprise at least one elevation extending outward from the outer side of the closure element and forming a closure surface on the outer side, the varying width and/or height of which along direction B dictates the flow resistance through the first and/or second chamber opening when the closure surface slides along the first and/or second chamber opening.

Preferably provided is for the width of the first closure surface opening and/or the depth of the first recess to increase at least sectionally in the direction of the movement, and whereby the width of the second closure surface opening and/or the depth of the second recess decreases at least sectionally in the direction of the movement.

Preferably provided is for the first chamber opening and the at least one closure surface to define a first connecting channel with a variable first flow resistance R1, whereby said first connecting channel connects the pipetting channel to the valve chamber, and whereby the second chamber opening and the at least one closure surface define a second connecting channel with a variable second flow resistance R2, whereby said second connecting channel connects the bypass channel to the valve chamber, wherein the distribution of the chamber pressure on the pipetting channel and the bypass channel changes the R2/R1 ratio, whereby the ratio in particular increases during the movement.

Preferably provided is for the closure element to comprise a first recess which extends from the closure surface into the depth of the closure element and forms a first closure surface opening in the closure surface, and whereby the closure element comprises a second recess which extends from the closure surface into the depth of the closure element and forms a second closure surface opening in the closure surface, wherein particularly during the movement, the first closure surface opening lies against the first chamber opening and the second closure surface opening lies against the second chamber opening.

Preferably, the first and second recess are arranged in the same closure surface one after the other in the direction of movement, which then in particular also applies to the position of the first and second chamber opening. This thereby enables a slimmer design.

It is however also possible for the first and second recess to be arranged in the at least one closure surface parallel to one another or at a parallel offset to one another in the direction of the movement, which then in particular also applies to the position of the first and second chamber opening. This thereby makes optimal use of available space in the direction of movement as an adjustment path for the pressure on the first/second chamber opening so that a larger adjustment path is used per unit of pressure change and the user can thus better control the dosing.

Preferably, in particular with the configuration according to the preceding paragraph, the first recess is arranged on a first closure surface of the closure element and the second closure element is arranged on a second closure surface of the closure element. The first and second closure surface can be arranged so as to not be parallel to one another on the closure element or can be arranged parallel to one another, in particular on opposite sides of the closure element.

In the direction of the—in this case, translational—movement, the closure element can have a triangular cross section, a rectangular or square cross section, a pentagonal, hexagonal or generally polygonal cross section, or can be oval or circular. In the case of a polygonal cross section, a closure surface is preferably substantially planar. Depending on the number of closure surfaces, different dosing profiles can be realized on the pipetting apparatus, particularly in order to make different dosing rates available. The closure element is thereby preferably designed to be rotatable about the axis of the direction of movement so that the user can orient the desired closure surface at the first and second chamber opening.

Preferably provided is for the closure element to have at least one first closure surface and one second closure surface which are not parallel and in particular oriented at an angle of $60° <= \alpha <= 120°$ to each other.

Preferably provided is for the first closure surface to be positioned opposite the first chamber opening and slide along same and the second closure surface to be positioned opposite the second chamber opening and slide along same during the movement.

Preferably provided is for the first and/or second chamber opening to comprise a sealing section which the at least one closure surface contacts, particularly to seal the first and/or second chamber opening in substantially completely gas-tight manner in at least one position of the closure element.

Preferably provided is for the valve chamber and/or the closure element to comprise at least one sealing section in order to seal the valve chamber in substantially completely gas-tight manner in at least one position of the closure element and/or during the movement.

In the context of the present invention, the expression "connect two air-filled areas of the valve assembly" means that the two areas are connected to one another by a connecting channel so that in particular air can be moved between both areas, in particular can be moved independently of direction. Such a connection can in particular be indirect or "direct." In the context of the present invention, the term "direct connection" of two air-filled areas of the valve assembly in particular means that the two areas are connected by a unbranched connecting channel, whereby it is possible for a variable flow resistance to be provided in the connecting channel, e.g. a device with restricting function, in particular a throttle valve. In the case of an indirect connection, the two areas can be connected for example by means of multiple lines or chambers and/or along e.g. one or more branching points.

A channel, in particular a connecting channel, can be a line, in particular a hose line, or can be a differently designed area of the valve assembly or pipetting apparatus for guiding the flow medium, e.g. a channel integrated into a cast-molded component.

Preferably, exactly one pump device is provided which is in particular a diaphragm pump or comprises same. The pump device preferably has a first pump channel at the inlet side which is designed as a suction channel for suctioning the fluid sample into the pipetting container connected to the pipetting channel. The pump device preferably has a second pump channel at the outlet side which is designed as a press channel for pressing the fluid sample out of the pipetting container connected to the pipetting channel.

Preferably, the valve assembly has exactly one bypass channel. Preferably, the at least one pump channel directly connected to the pump device is directly connected to the surroundings and/or the bypass channel. In a valve device designed to suction the sample to be pipetted into the pipetting container, the outlet pump channel is preferably connected directly to the bypass channel and/or the surroundings. In a valve device designed press the sample to be pipetted out of the pipetting container, the inlet pump channel is preferably connected directly to the surroundings and/or the bypass channel.

In one preferential embodiment of the invention, the pump device is connected to the valve chamber of a first valve device and to the valve chamber of a second valve device.

Preferably, the pipetting channel is connected to the valve chamber by a first connecting channel with variable flow resistance and preferably the bypass channel is connected to the valve chamber by a second connecting channel with variable flow resistance, whereby the valve device adjusts, in particular simultaneously adjusts, the first flow resistance and the second flow resistance in order to generate the desired pipetting pressure in the pipetting channel. Variable flow resistances can be constructionally integrated relatively efficiently.

Preferably, the valve device comprises a closure support element and preferably at least one closure element arranged preferably translationally movable, preferably rotationally movable, preferably translationally and/or rotationally movable at least between a first position and a second position vis-à-vis the closure support element and/or the valve chamber.

In the first position, the closure element preferably closes the first connecting channel and/or the first chamber opening and at the same time preferably does not close the second connecting channel and/or the second chamber opening.

In the second position, the closure element preferably does not close the first connecting channel and/or the first chamber opening and at the same time preferably closes the second connecting channel and/or the second chamber opening.

The closure element, in particular only one closure element, in particular enables the first flow resistance and the second flow resistance to be simultaneously regulated. This thus enables easily realizing the pipetting pressure adjustment, which is also referred to as metering the pipetting pressure.

A closure element is preferably a valve piston and the closure support element and/or the valve chamber in this case preferably designed as a piston support element and/or piston cylinder element. A precise translating of the valve piston movement into a pressure change in the first and/or second connecting channel is thereby possible and thus an exact regulating of the pipetting pressure in the pipetting channel. It is also possible and preferential for the closure element to not be designed as a valve piston and the valve chamber not as a piston cylinder. The gas-tight sealing between the closure element and the valve chamber is then realized preferably by a sealing section, e.g. a flexible sealing ring or O-ring, e.g. of silicone, which can be arranged on or respectively affixed to the closure element or to the valve chamber or on the closure support element respectively.

Preferably, the closure element and/or the valve chamber and/or the closure support element is an injection-molded part, whereby efficient production is enabled. In particular, the injection-molding process enables the at least one closure surface to be efficiently designed. The closure element could also be produced as a turned part by turning or as a milled part by milling or by a combination of such production techniques.

Preferably, the closure element is spring-mounted by a spring device which presses the closure element into the first position and which is tensioned by the movement of the closure element from the first position into the second position.

Preferably, the closure element is designed such that it partly opens the first connecting channel and the second connecting channel when it is disposed in at least one third position between the first and second position. Preferably, the first connecting channel and the second connecting channel are each partially opened over at least half of the distance between the first and second position. This third position enables the pump device to not only be connected to the pipetting channel but also simultaneously to the bypass channel open to the surroundings. By so doing, fluctuations in the chamber pressure are at least not transmitted in full to the pipetting channel but rather attenuated, thereby enabling exact pipetting.

Preferably, the closure element is designed such that it continues to close the first connecting channel in a third position as in a fourth position, and preferably continues to close the second connecting channel in the fourth position as in the third position. The third position and fourth position are thereby in particular between the first position and second position. This measure enables precisely adjusting the distribution of the pressure drop from the chamber pressure via the pipetting channel and via the bypass channel as a function of the position of the closure element. Preferably, the third position is closer to the first position and the second position is closer to the fourth position.

Preferably, the pipetting apparatus is manually operable, whereby the valve device is designed such that the user determines the position of the closure element in order to set the desired pipetting pressure in the pipetting line. It is preferably provided for the user to prompt the movement of the closure element. However, it is also possible for the movement of the closure element to be electrically powered and in particular controlled by a preferably provided electrical control device of the pipetting apparatus.

In a first preferential embodiment of the invention, the pump device is connected to the valve chamber of a first valve device and to the valve chamber of a second valve device. Preferably, a first pump channel of the pump device is connected to the first valve device and a second channel of the pump device connected to the second valve device. The pump device thereby preferably comprises one pump, in particular a diaphragm pump, preferably one single pump. According to the first preferential embodiment of the invention, the pipetting apparatus preferably comprises at least one, preferably exactly one, first valve device having a first valve chamber and one, preferably exactly one, second valve device having a second valve chamber, whereby the at least one, preferably exactly one, pump device is connected to the first valve chamber in order to generate a first chamber pressure in said first valve chamber and connected to the second valve chamber in order to generate a second chamber pressure in said second valve chamber, wherein the first valve chamber and the second valve chamber are in each case connected to the at least one, preferably exactly one, pipetting channel and the at least one, preferably exactly one, bypass channel. Preferably, the first valve device is designed such that a suitable pressure is set in the pipetting channel for suctioning a fluid sample into a pipetting container hermetically connected to the pipetting channel. Preferably, the second valve device is designed such that a suitable pressure is set in the pipetting channel for dispensing a fluid sample from a pipetting container hermetically connected to the pipetting channel.

Preferably, the pipetting apparatus is furthermore manually operable and designed such that to suction in the fluid sample, the connecting channel between the first valve chamber and the pipetting channel is at least partly open and the connecting channel between the second valve chamber and the pipetting channel is closed, and that preferably to dispense the fluid sample, the connecting channel between the first valve chamber and the pipetting channel is closed and the connecting channel between the second valve chamber and the pipetting channel is at least partly open.

Preferably, the pipetting apparatus is furthermore manually operable and designed such that to suction in the fluid sample, the connecting channel between the first valve chamber and the bypass channel is at least partly open or closed and the connecting channel between the second valve chamber and the bypass channel is open, and that preferably to dispense the fluid sample, the connecting channel between the first valve chamber and the bypass channel is open and the connecting channel between the second valve chamber and the bypass channel is at least partly or completely closed.

Preferably, the pipetting apparatus is furthermore designed such that substantially only the volume of air which corresponds to the air volume needed to set the desired pipetting pressure in the pipetting channel is exchanged with the surroundings through the bypass channel, whereby an exchange of air preferably substantially only occurs when setting the pipetting pressure and preferably does not substantially occur once the desired pipetting pressure has been reached. The volume of air exchanged between the valve assembly and the surroundings is preferably the net volume flow of the air during the suction process or during the expelling process. This design provides the advantage of an exchange of air with the surroundings substantially only occurring to the extent necessary to change the pipetting pressure. This on the one hand prevents an unnecessary volume of damaging, e.g. moist, ambient air from being drawn into the valve assembly. On the other hand, an unnecessary volume of air is not dispensed from the valve assembly into the surroundings, making for a more pleasant user experience.

Preferably, the pipetting apparatus comprises exactly one pump device and at least one first pump channel for the suctioned air which is connected to the pump device on the intake side and one second pump channel for the emitted air which is connected to the pump device on the discharge side, whereby preferably the first pump channel is connected to the first valve chamber and the second pump channel is connected to the second valve chamber such that both the suction pressure in the first valve chamber as well as the discharge pressure in the second valve chamber can be produced by means of the one pump device. Such an arrangement can be realized particularly economically.

In a second preferential embodiment of the invention, the valve assembly comprises exactly one valve device. The pump device is in particular preferably designed in this case to reverse the pumping direction so that each of the two pump channels of the pump device can function both as a suction channel (input channel) as well as a pressure channel (output channel).

Preferably, the pipetting apparatus is designed as a hand-operable electrical pipetting apparatus in particular comprising a pistol-like grip having at least one user-adjustable actuating element, through the actuation of which the chamber pressure is controlled by the user in order to generate the desired pipetting pressure in the pipetting channel and is distributed in metered manner by the at least one valve device to the pipetting channel and the bypass channel.

Preferably, the pipetting apparatus comprises a device for automatically adjusting the pumping capacity of the at least one pump device as a function of the position of the valve device's closure element vis-à-vis the valve device's base body. Preferably, the pipetting apparatus comprises a device for automatically adjusting the pumping capacity of the at least one pump device as a function of the position of the actuating element vis-à-vis the valve device's base body. Said device can comprise a position sensor for detecting the position of the closure element, in particular the valve piston, and/or the actuating element. The position sensor can be a Hall sensor. Alternatively, optical position detection would also be possible. The maximum pumping capacity can also be set manually by a variable resistor, in particular manually variable resistor, and in particular by a potentiometer. Preferably, the pipetting apparatus exhibits a variable resistance and is in particular designed to set the maximum pumping capacity by means of the variable resistance.

The method according to the invention for producing the inventive pipetting apparatus preferably comprises the steps:

producing the at least one valve device of the valve assembly at least partly from a first material which can in particular be plastic, composite or ceramic; preferably: producing at least one closure element, particularly from in particular plastic, composite or ceramic, in particular metal, for example as a turned or milled part or as a combination turned/milled part; i.e. as a part manufactured by a combined turning and milling process, and in particular from injection-molded plastic;

producing the at least one pipetting channel, and in particular also the at least one bypass channel, at least partly from a second material which is in particular different from the first material;

preferably: at least partially producing the at least one pipetting channel, and in particular also at least partially the at least one bypass channel, in particular integrally producing, in particular utilizing a casting process, wherein the second material is in particular plastic.

Preferably, at least one support component is provided for the valve assembly which is in particular integrally produced and which preferably comprises at least one part of the pipetting channel, preferably comprises at least one part of the bypass channel, and preferably comprises at least one part of the valve chamber of at least one valve device, preferably of exactly two valve devices. Preferably, said component comprises at least one receiving area for receiving a piston support element, in particular exactly two such receiving areas.

A pipetting container is in particular a hollow cylinder-like container which has a first opening for drawing in/dispensing the fluid sample and at least one second opening for applying the pipetting pressure. Preferably, the pipetting container comprises a connecting section via which it is detachably connectable, in particular in air-tight and pressure-tight manner, to the corresponding preferably provided connecting section of the pipetting apparatus. A pipetting container is preferably a commercially available graduated pipette or volumetric pipette. The possible pipetting container sizes; i.e. the maximum capacity of a pipetting container, can in particular range between 0.1 ml and 100 ml. The fluid sample is usually a liquid, in particular a predominantly aqueous sample, e.g. a physiological aqueous solution.

Further preferential embodiments and features of the inventive pipetting apparatus and the inventive method for its production will be yielded by the following description of the example embodiments in conjunction with the figures and their description. Identical components of the example embodiments are substantially identified by the same reference numerals unless stated otherwise or otherwise clear from the context. Shown are:

FIG. 1 shows a first example embodiment of the pipetting apparatus according to the invention in a schematic side view.

Figure 2A:
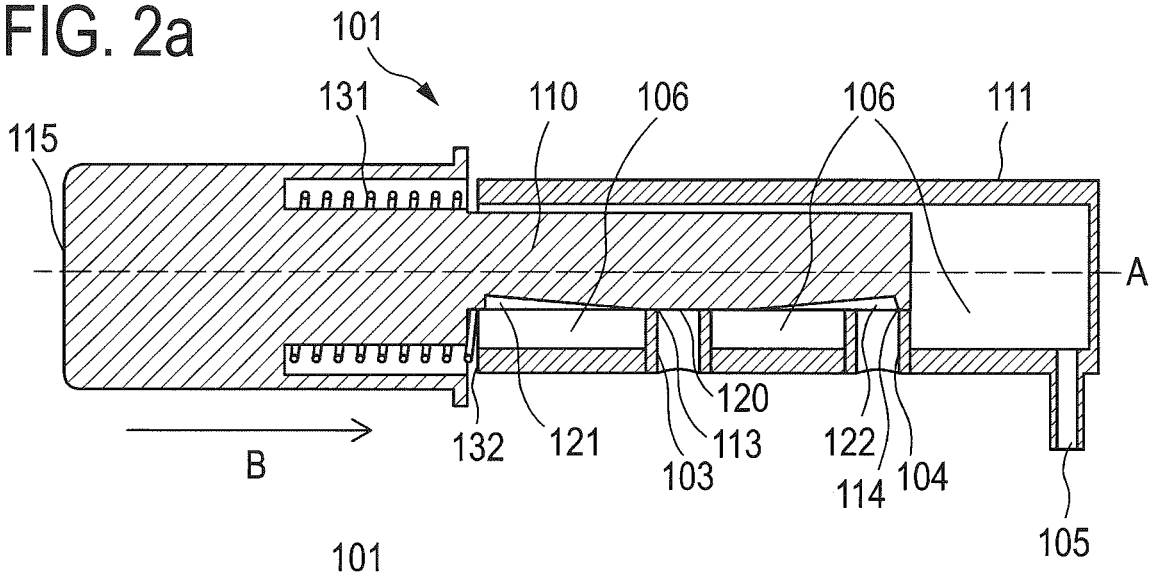

FIG. 2*a* shows a cross-sectional view through a valve device of the pipetting apparatus in FIG. 1 according to a first preferred embodiment of the invention in a first state.

Figure 2B:
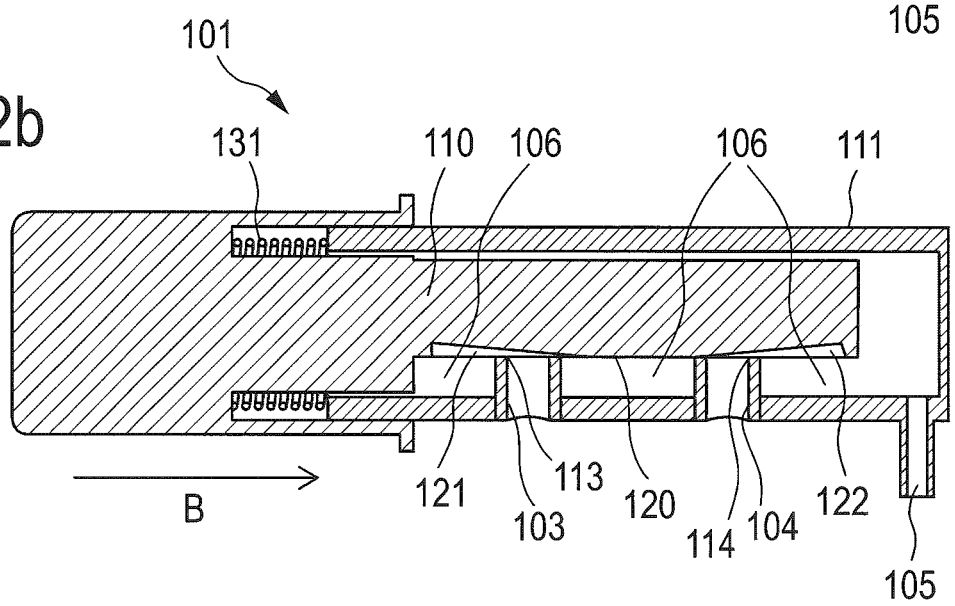

FIG. 2*b* shows the valve device of FIG. 2*a* in a second state.

Figure 2C:
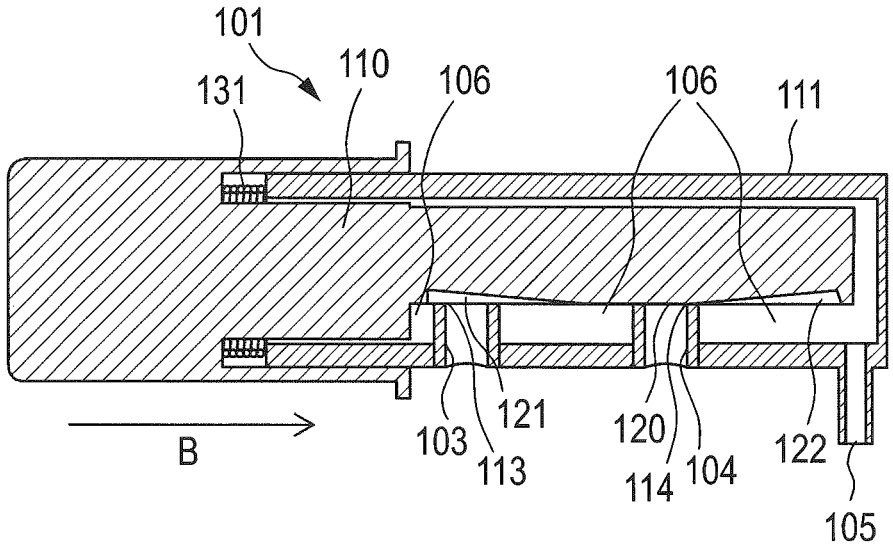

FIG. 2*c* shows the valve device of FIG. 2*a* in a third state.

Figure 3A:
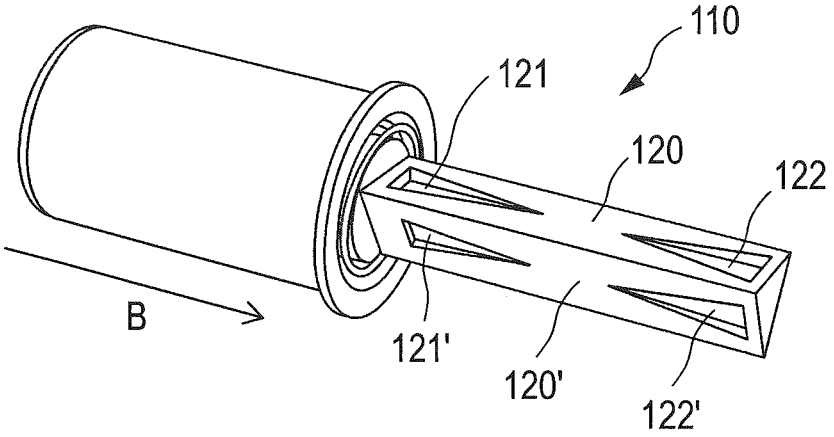

FIG. 3*a* shows an isometric oblique view of an insertable closure element for the valve device of an inventive pipetting apparatus according to a first example embodiment.

Figure 3B:
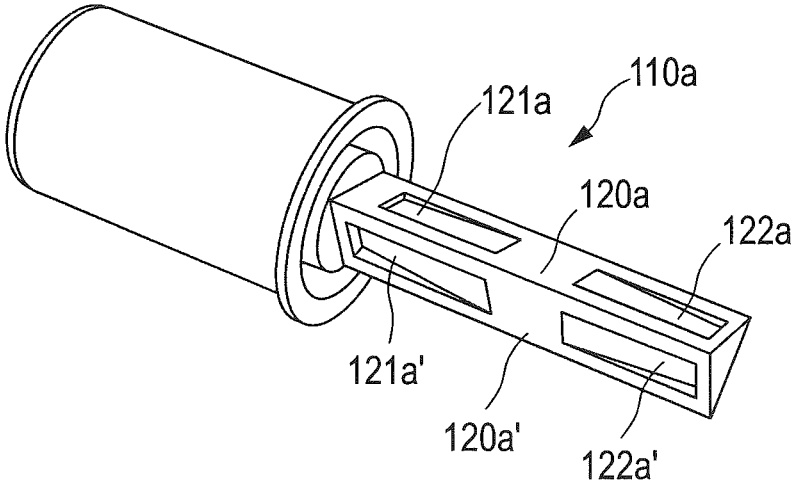

FIG. 3*b* shows an isometric oblique view of an insertable closure element for the valve device of an inventive pipetting apparatus according to a second example embodiment.

Figure 3C:
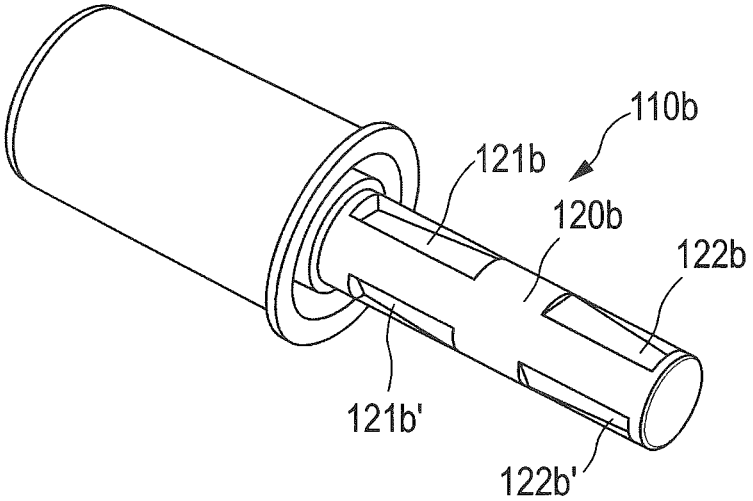

FIG. 3*c* shows an isometric oblique view of an insertable closure element for the valve device of an inventive pipetting apparatus according to a third example embodiment.

Figure 3D:
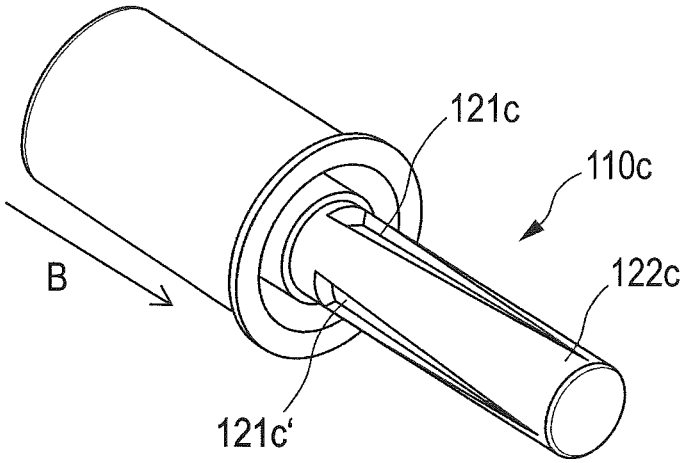

FIG. 3*d* shows an isometric oblique view of an insertable closure element for the valve device of an inventive pipetting apparatus according to a fourth example embodiment.

Figure 3E:
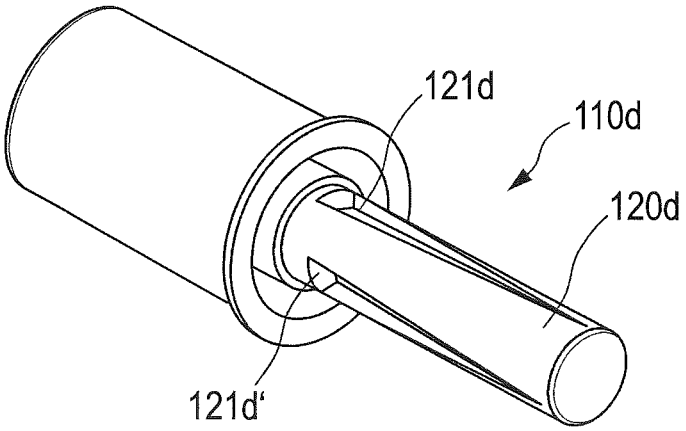

FIG. 3*e* shows an isometric oblique view of an insertable closure element for the valve device of an inventive pipetting apparatus according to a fifth example embodiment.

Figure 4:
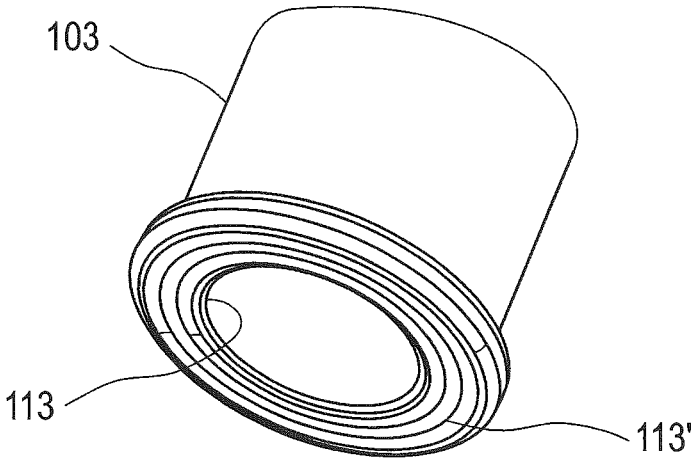

FIG. 4 shows an isometric oblique view of the valve chamber section with pipetting channel and first chamber opening used in the FIG. 3*a* valve device of the inventive pipetting apparatus.

FIG. 1 shows one example embodiment of an inventive pipetting apparatus 1. This pipetting apparatus 1 serves as an electrically operated manual pipettor for use with volumetric pipettes or graduated pipettes 9 made of glass or plastic as available from the laboratory supplies trade in different sizes with filling volumes ranging between 0.1 mL (milliliter) and 100 mL.

In describing the invention, the terms "above" and "below" are in particular used. These refer to a spatial arrangement of the pipetting apparatus in which a pipetting container extending along a longitudinal axis and connected to the pipetting apparatus, is disposed parallel to the direction of gravity, i.e. vertically. The "downward" directional indication designates the gravitational direction, the "upward" indication designates the opposite direction.

The pipetting apparatus 1 is an air-cushion pipetting apparatus which in particular serves in pipetting a fluid sample by suctioning it into a pipetting container by means of air under a first pipetting pressure and/or serves in dispensing or pressing a fluid sample out of a pipetting container by means of air under a second pipetting pressure. The air-cushion pipetting apparatus uses air as a working medium in order to effect the transport of the fluid sample into and out of the pipetting container. This will be explained further in the following:

In FIG. 1, the fluid sample 9*a* is shown as the hatched area in the pipetting container 9. Air which is expanded relative to the ambient pressure, thus under a negative pressure, is located above the hatched area in area 9*b* of the pipetting container. The negative pressure is the pipetting pressure applied via the pipetting channel to suction the sample, which in FIG. 1 holds the sample 9*a* in the container at a constant height against the force of gravity. The first pipetting pressure for suctioning the sample is in particular selected such that it is at least lower than the ambient pressure to which the sample to be pipetted is exposed. The first pipetting pressure for suctioning the sample is in particular selected such that it applies the necessary counterforce to raise or maintain the liquid column 9*a* in the pipetting container 9, said counterforce being in particular substantially at least as great as the weight of the liquid column 9*a*. The second pipetting pressure for dispensing the fluid sample 9*a* from the pipetting container 9 must be at least as low as the first pipetting pressure, in particular at least low enough for the liquid column to overcome the counterforce effected by the pipetting pressure (negative pressure) and be dispensed gravitationally. To press the fluid sample out of the pipetting container, the second pipetting pressure is in particular at least greater than the ambient pressure.

The pipetting apparatus 1 comprises a housing 2 as a base body 2 which has a boom section 4 with a connecting section 5 of the pipetting apparatus provided on its lower side end at which the pipetting container 9 detachably and hermetically connects to the connecting section 5. The connecting section is designed here as a replaceable, screwable receiving cone 5. It incorporates a clamping section (not visible) for frictionally holding the pipetting container 9 insertable into the clamping section 9 and a membrane filter (not visible) which is inserted into the pipetting channel between the boom section 4 and the pipetting container 9. The membrane filter prevents the fluid sample to be pipetted from penetrating into the pipetting apparatus or its valve device respectively. This thus ensures the continued functioning of the pipetting apparatus.

The base body 2 further comprises a pistol-like grip section 3. A battery or respectively accumulator unit 6 is arranged in a battery compartment open or openable to the bottom in the interior of said grip section 3. The accumulator unit 6 can comprise e.g. a nickel metal hydride or a lithium polymer or a lithium-ion/polymer accumulator able to provide e.g. an operating voltage of 9V. The accumulator unit 6 can be dislodged downward out of the base body 2 in the manner of a pistol magazine and is preferably held to the base body by a (not shown) latching device. A pump device 7 electrically operated by the operating voltage of the accumulator unit and comprising an electrically operated diaphragm pump of adjustable pumping capacity is additionally accommodated in the interior of the grip section 3. An electrical control device 8 inside the housing 2 comprises electrical circuits, in particular programmable electrical circuits. The control device 8 is designed to control at least one function of the electrically operated pipetting apparatus 1.

Further arranged in the interior of the grip section 3 is a valve assembly with two valve devices which can in particular be designed as per FIGS. 2*a* to 2*c* and with which particularly a closure element can be adapted as is shown in one of FIGS. 3*a* to 3*e*.

The pipetting apparatus 1 comprises two actuating elements 11, 12 for manually actuating the two valve devices of the valve assembly. The actuating elements are designed as pushbuttons 115 spring-mounted by means of spiral springs 131, their spiral springs 131 tensioned when the user's finger moves the pushbutton out of its initial position into the pressed-in position. The pushbuttons 11, 12 can be moved independently of each other. The two actuating elements 11, 12 are arranged parallel one above the other and horizontally movable and undetachable from the base body 2. Each actuating element 115 in the valve device 101 according to the first preferential embodiment of the invention is preferably rigidly fixed at least in one direction along the A axis (see FIG. 2*a*) to a closure element 110 of the valve assembly valve device 101, in particular by means of injection molding as an integrally produced component with the closure element 110.

As shown in FIGS. 2*a* to 2*c*, the user directs the closure element from the first position, shown in FIG. 2*a*, into the third position, shown in FIG. 2*b*, and from there optionally into the second position, shown in FIG. 2*c*, by way of movement B. If the user exerts a lower force than that applied by the compressed spiral spring 131 between the valve support element 111 and the closure element 110, the closure element is then reset by the spring action.

In the first position, shown in FIG. 2*a*, the pipetting channel 103 and the first chamber opening 113 of the valve chamber 106 are completely closed by the planar closure surface 120 sealingly contacting the edge of the first chamber opening or the sealing section 113' realized as a silicone O-ring 113' preferably provided there respectively so as to prevent gas from passing through the first chamber opening 113, in particular in any typical operating state of the pipetting apparatus. In the context of the present description of the invention, the sealing section shown in FIG. 4 can generally be realized not only as an elastic O-ring but, for example, also be completely configured as an elastomer section of the pipetting channel; in particular, the pipetting channel can be partly or completely made of elastomer. The bypass channel 104 is furthermore open in the first position of the closure element, namely not closed off by the closure surface 120 since the second chamber opening 114 here is situated opposite the second recess 122 of the closure element. The second recess 122 keeps the flow path here maximally opened via the second chamber opening 114 so that a chamber negative pressure or chamber positive pressure, relative to the ambient pressure; i.e. here the atmospheric pressure, effects flow through the bypass channel 104 if the pump device is active and acts on a flow through the pumping channel. However, the pump device is preferably inactive in the first position, in particular by the pump device not being activated until a turn of the actuating knob 115 has been mechanically activated. In the first state of the valve assembly, in particular a liquid column 9*a* can be held at a constant height by a suitable pipetting pressure (negative pressure) in the pipetting channel.

In the second position, shown in FIG. 2*c*, the bypass channel 104 and the second chamber opening 114 of the valve chamber 106 are completely closed by the planar closure surface 120 sealingly contacting the edge of the second chamber opening or the sealing section 113' realized as a silicone O-ring 113' preferably provided there respectively so as to prevent gas from passing through the second chamber opening 114, in particular in any typical operating state of the pipetting apparatus. The pipetting channel 103 is furthermore open in the second position of the closure element, namely not closed off by the closure surface 120, since the first chamber opening 113 here is situated opposite the first recess 122 of the closure element. The first recess 121 keeps the flow path through the first chamber opening 113 maximally open here so that the chamber negative pressure or chamber positive pressure, related approximately roughly to the ambient pressure (more precisely: relative to the pressure applied with inactive pump and motionless liquid column 9*a* in area 9*b* and in the pipetting line which deviates from the ambient pressure due to the gravitational and suction effect of the liquid sample 9*a* in the pipette 9), effects a maximum air flow through the pipetting channel 103.

In a third position, shown in FIG. 2*b*, in which the closure element is arranged between the first and second position, the first chamber opening 113 and the second chamber opening 114 are in each case partly open. A first flow resistance thereby ensues through the first connecting channel which is dictated by the flow sections situated between the valve chamber 106 and the pipetting channel 103. Among these flow sections is in particular the section of the first closure surface opening of the first recess 121 adjacent the first chamber opening in this third position which opens to the closure surface 120. A cross section of the first recess 121 changing along the direction of movement B is realized here which can be induced by a recess and/or closure surface opening width changing along direction B or by a depth changing along direction B, see the embodiments of possible closure elements and their recesses in FIGS. 3*a* to 3*e*. Due to the changing cross section of the first recess 121 along direction B, a first flow resistance dependent on the position of the closure element is realized.

Similarly, the second connecting channel yields a second flow resistance which is dictated by the flow sections situated between the valve chamber 106 and the bypass channel 104. Among these flow sections is in particular the section of the closure surface opening of the second recess 122 adjacent the second chamber opening 114 in this third position which opens to closure surface 120. Due to the R2/R1 relationship of the second flow resistance R2 to the first flow resistance, the chamber pressure applied in the valve chamber can be distributed or metered respectively to the pipetting channel and the bypass channel so that the user-desired pressure which results in suctioning or expelling the fluid sample 9*a* from the pipette 9 can be generated in the pipetting channel.

Preferably, the pipetting apparatus comprises a blocking device which automatically blocks, in particular locks, one actuating element 11 when the other actuating element 12 is actuated and vice versa. The blocking device can comprise a locking bar element which is mechanically displaced by an actuating element being actuated so as to block the mobility of the other actuating element in a blocked state. The blocking device can however also be designed to set the blocking state electrically.

The first actuating element 11 serves in the suctioning of the fluid sample into the pipetting container. The second actuating element 12 serves in the dispensing/pressing out of the fluid sample from the pipetting container.

The valve assembly of the pipetting apparatus 1 is constructed of different components in the example embodiment which are in particular joined together. These components in particular comprise a support component (not shown), in particular two closure support elements, two closure elements 110, 110' and sealing rings, in particular sealing rings 113'. A sealing section, in particular a sealing ring, can in particular be provided in each case at the outer end 132 of the valve chamber 106, or the closure support element 111 respectively, as shown in FIG. 2*a*. The closure support element 111 can be of a shape with its interior adapted to the shape of the closure element 110 and enables the particularly translational movement B of the closure element 110 within the closure support element 111. To that end, the valve chamber 106 is designed as a receiving section of the closure element 110.

Each receiving section is outwardly open on one side in order to enable the inserting of a first closure element 110, respectively second closure element 110. Each closure element preferably exhibits a small clearance fit relative to its receiving section so that a closure element can in each case be non-positively fixed in the receiving section by the compressing of at least one sealing ring, e.g. at position 132 (FIG. 2*a*). The sealing rings are preferably of a sealing design so as to produce an airtight and a (negative) pressure-tight seal under the intended use of the pipetting apparatus.

Producing the valve assembly is particularly simple and economical, and thereby efficient, because the cited components can be easily assembled simply by fitting them together, in particular without the use of special tools and/or complicated securing steps when assembling.

The further the closure element 110 is moved into the first position, the larger the volume of air drawn through the bypass channel 104. The volume of air suctioned through the pipetting channel is thereby correspondingly smaller. As a consequence, the lifting speed (volume per time) of the fluid sample into the pipetting container connected to the pipetting channel and the maximum liquid column in the pipetting container is low due to the gravitational force acting on the liquid column. Correspondingly holding true is that the further the closure element 110 is moved into the second position, the smaller of a percentage of air is drawn through the bypass channel 104. The volume of air suctioned through the pipetting channel is thereby correspondingly larger. If the closure element 110 is maximally moved into the closure support element 111 (second position), substantially no further air is drawn via the bypass line 104. The volume of air suctioned out of the pipetting channel 103 thereby achieves a maximum value. In consequence, the lifting speed and the liquid column are in each case at their maximum in the pipetting container. Additionally to controlling the lifting speed via the bypass channel 104, the change in cross section, in particular the conical form to at least one recess (121, 122) of the closure element 110, effects a regulating of the air speed along the airflow path from the inlet into the interior space of the closure support element 111 to the pipetting channel 103. This functionality of the valve assembly will in particular be described below. The lifting speed of the liquid column into the pipetting container can thereby be even more finely regulated.

Should the user, starting from the second state of the valve device 101 in FIG. 2*b*, convey the closure element 110 from the third position back into the first position in order to stop the suction process, it is preferably provided for the pumping capacity to be regulated in a predetermined manner by the electrical control device such that the pumping capacity is set as a function of the first flow resistance in the first connecting channel so the pipetting pressure remains constant until the closure element again reaches the first position. The liquid column suctioned by the user into the pipetting container thereby remains at a constant volume. When the closure element is moving from the third position into the first position, it is particularly possible for the pumping capacity prevailing in the third position to be kept at least constant until the first position is reached.

The pipetting pressure in the pipetting channel 103 is in each case set by one valve device whereas the other valve device is not substantially affected as particularly the first connecting channel of the other valve device is closed. The second connecting channel or the second chamber is preferably at least partially opened particularly in the third position lying between the position of the closure element in the first and/or second position, and is in particular in a third position which is closer to the first position than the second position, preferably open to at least half of the maximum opening or maximum opening volume. This respective bypass connection of the valve chamber of the valve device to the surroundings in particular achieves the pressure fluctuations in the valve chamber, which can be caused by the pump device, not being transmitted in full to the pipetting channel and thus to the liquid column but rather given off proportionately to the surroundings by the bypass and thus efficiently attenuated, in particular at minor deflections of the valve piston from the first position and particularly at low pumping capacities and/or pump frequencies. At full pumping capacity, even pipetting containers of low dosing volume can be filled very precisely. So doing enables more precise and easy pipetting.

A further adjusting of the pipetting behavior occurs with the pipetting apparatus 1 in that the pumping capacity is infinitely variable. To that end, the base body 2 comprises at least one Hall sensor as a position sensor (not shown), by means of which the position of the closure element is detected relative to the base body or relative to the closure support element 111 respectively. The electrical control device 8 is designed to change the pumping capacity, in particular increase the pumping capacity, as a function of the measured position and/or measured speed of the valve piston 110 along the A axis when the user presses the closure element farther inside the closure support element 111 by gradually pressing the actuating element. Use of the pipetting apparatus is thereby made more efficient, in particular easier, and the adjusting of the pumping capacity more flexible. In particular, the pump can be immediately activated by means of the position sensor or another e.g. mechanical switch. The mechanical switch can, for example, be automatically triggered by a plate on the actuating element when the user pushes the actuating knob out of the starting position, preferably when the user moves the valve piston out of the first position. This applies at least to the actuating element for suctioning in the sample. Preferably provided for the actuating element for dispensing the sample is for the pump to only become active when the closure element 110 reaches a specific third position; i.e. depression depth, since prior to reaching the third position, dispensing is gravity-driven and does not require any positive pressure. Sample dispensing controlled by opening the second connecting channel is efficient and convenient, and the pumping activity can additionally accelerate the dispensing to the desired extent.

A further particular advantage of the inventive pipetting apparatus according to the first preferential embodiment with the valve assembly is as follows: The pipetting apparatus is configured such that substantially only that volume of air is exchanged with the surroundings through the bypass line 104 which corresponds to the volume of air needed to set the desired pipetting pressure in the pipetting channel, whereby an exchange of air substantially occurs preferably only when setting the pipetting pressure and preferably does not substantially occur when the desired pipetting pressure is reached. This exchanged volume of air represents in particular a net flow between the flow regions of the valve assembly and the surroundings, thus either the net volume supply of air from the surroundings or the net volume discharge of air to the surroundings. Thus, less—potentially harmful, e.g. most—external air reaches the channel areas of the valve assembly and, vice versa, less air from the valve assembly is emitted to the surroundings, which makes for a more pleasant user experience.

This is attained in the example embodiment particularly by the pipetting apparatus having exactly one pump device with, for example, exactly one diaphragm pump, and at least one first—or exactly one first—pump channel 105 for the suctioned air, connected on the intake side to the pump device, and at least one second—or exactly one second—pump channel for the emitted air, connected on the discharge side to the pump device, wherein the first pump channel is connected to the first valve chamber of the first valve device and the second pump channel is connected to the second valve chamber of the second valve device so that both the intake pressure in the first valve chamber as well as the discharge pressure in the second valve chamber can be produced by means of the one pump device.

FIG. 3*a* shows the closure element 110 insertable into an inventive pipetting apparatus 1 according to a first example embodiment. The closure element comprises a first closure surface 120 which is planar and arranged parallel to direction of movement B. When viewed in cross section perpendicular to direction of movement B, the closure element is additionally triangular, here corresponding to an equilateral triangle, the sides being at an angle of cx=60° to each other. Other cross-sectional shapes with other numbers of sides, in particular planar sides, are possible and preferential. The area of the closure element with closure surfaces 120 does not serve as a piston element sealing the interior of the closure support element. It is only provided for the respective closure surface 120, 120' to be able to slide parallel along the first and second chamber opening 113, 114 in order to fully close them in position-dependent manner or partially close them in gas-tight manner.

The form to the first closure surface differs from the form to the second closure surface. The user can take the closure element out of the closure support element 111, rotate it, and reinsert it such that a different closure surface is facing the first and second chamber opening. A different pipetting behavior of the pipetting apparatus is thereby set, in particular the pipetting speed impacted. The first recess 121 of the first closure surface 120 preferably differs in its width and/or depth from the first recess 121' of the second closure surface 120'. The second recess 122 of the first closure surface 120 preferably differs in its width and/or depth from the second recess 122' of the second closure surface 120'.

It is in principle also possible and preferential for the closure element to only comprise one single closure surface in order to realize only one pipetting behavior of the pipetting apparatus. The closure element can then also be non-detachably connected to the closure support element 111.

FIG. 3*b* shows the closure element 110*a* insertable into an inventive pipetting apparatus according to a second example embodiment. The closure element is realized similar to closure element 110 but comprises recesses 121*a*, 122*a*, 121*a'*, 122*a'* of a substantially constant width so as to result in a rectangular closure surface opening. The changing flow resistance along direction B is in each case substantially attained here by a changing recess depth along direction B.

FIG. 3*c* shows the closure element 110*b* insertable into the inventive pipetting apparatus according to a third example embodiment. The closure element is realized similar to closure element 110; i.e. comprising recesses 121*a*, 122*a*, 121*a'*, 122*a'* of a substantially constant width so as to result in a rectangular closure surface opening. Here as well, the changing flow resistance along direction B is in each case substantially attained by a changing recess depth along direction B. The recesses here are distributed in pairs one behind the other in direction B about a cylindrical section of the closure element 110*b* or its only cylindrical closure surface 120*b* respectively. The user can orient a pair of recesses to the first and second chamber opening by rotating the closure element 110*b*, whereby the rotational position of the closure element is preferably secured at said orientation by a locking device (not shown).

FIG. 3*d* shows the closure element 110*c* insertable into the inventive pipetting apparatus with further adaptation of the chamber opening arrangement according to a fourth example embodiment. The closure element exhibits the cylindrical section with cylindrical closure surface 120*c*. A first recess 121*c* tapering in direction B serves to open the pipetting channel, a second recess 122*c* (not visible) widening in direction B opposite from recess 121*c* serves to simultaneous close the bypass channel upon movement in direction B. The first and second chamber opening are thereby oppositely arranged on the valve chamber (not shown) corresponding to the position of recesses 121*c* and 122*c*. A further pair of recesses 121*c'* and 122*c'* (not visible) can be adjusted by the user rotating the closure element 110*c*.

FIG. 3*e* shows the closure element 110*d* insertable into the inventive pipetting apparatus with further adaptation of the chamber opening arrangement according to a fifth example embodiment, only differing from closure element 110*c* by the changing maximum depth of one, multiple or all of the recesses along direction B.

Different closure elements, e.g. closure element 110*c* and closure element 110*d*, can preferably be used with the same closure support element.

The invention claimed is:

1. A pipetting apparatus (7), in particular for pipetting a fluid sample (9*a*) by suctioning into a pipetting container (9) using air (9*b*) under a pipetting pressure, comprising:

a valve assembly having at least one valve device (101) for adjusting a pipetting pressure, wherein the valve device comprises a valve chamber (106);

at least one pump device (7) connected to the valve chamber in order to generate a chamber pressure in said valve chamber;

a pipetting channel (103) connectable to the pipetting container and a bypass channel (104) which is open to the surroundings;

wherein the valve chamber has a first chamber opening (113) connected to the pipetting channel and a second chamber opening (114) connected to the bypass channel, wherein the valve device comprises a closure element (110; 110*a*; 110*b*; 110*c*; 110*d*) at least partially disposed within the valve chamber which can be moved relative to the valve chamber by a user-controlled movement (B) and has at least one closure surface (120; 120*a*; 120*b*; 120*c*; 120*d*) which slides along said chamber openings parallel to the first and parallel to the second chamber opening during the movement and closes them as a function of the position of the closure surface, and wherein the at least one closure surface is formed such that in order to generate the desired pipetting pressure in the pipetting channel, the chamber pressure is distributed to the pipetting channel and the bypass channel as a function of the position of the at least one closure surface at the first and second chamber opening.

2. The pipetting apparatus according to claim 1, wherein the closure element comprises at least one recess (121; 122; 121*a*; 122*a*; 121*b*; 122*b*; 121*c*; 122*c*; 121*d*; 122*d*) which extends from the closure surface into the depth of the closure element and forms at least one closure surface opening in the closure surface, wherein said at least one closure surface opening has a length measured parallel to the direction of the movement (B) and a width measured perpendicular thereto, wherein the width of the at least one closure surface opening and/or the depth of the at least one recess varies at least sectionally in the direction of the movement, and in particular the closure surface with the at least one closure surface opening slides along the first and/or second chamber opening such that the closure cross section of the first and/or second chamber opening varies during the movement.

3. The pipetting apparatus according to claim 1, wherein the closure element comprises a first recess (121; 121*a*; 121*b*; 121*c*; 121*d*) which extends from the closure surface into the depth of the closure element and forms a first closure surface opening in the closure surface, and wherein the closure element comprises a second recess (122; 122*a*; 122*b*; 122*c*; 122*d*) which extends from the closure surface into the depth of the closure element and forms a second closure surface opening in the closure surface, wherein the first closure surface opening lies against the first chamber opening and the second closure surface opening lies against the second chamber opening during the movement.

4. The pipetting apparatus according to claim 3, wherein the width of the first closure surface opening and/or the depth of the first recess increases at least sectionally in the direction of movement and wherein the width of the second closure surface opening and/or the depth of the second recess decreases at least sectionally in the direction of movement.

5. The pipetting apparatus according to claim 1, wherein the first chamber opening and the at least one closure surface define a first connecting channel with a variable first flow resistance R1, wherein said first connecting channel connects the pipetting channel to the valve chamber, and wherein the second chamber opening and the at least one closure surface define a second connecting channel with a variable second flow resistance R2, wherein said second connecting channel connects the bypass channel to the valve chamber, wherein the distribution of the chamber pressure on the pipetting channel and the bypass channel changes the R2/R1 ratio, wherein the ratio in particular increases during the movement.

6. The pipetting apparatus according to claim 1, wherein the closure element comprises at least one first closure surface and one second closure surface which are not parallel and in particular oriented at an angle of $60° <= \alpha <= 120°$ to each other.

7. The pipetting apparatus according to claim 6, wherein the first closure surface is positioned opposite the first chamber opening and slides along same and the second closure surface is positioned opposite the second chamber opening and slides along same during the movement.

8. The pipetting apparatus according to claim 1, wherein the first and/or second chamber opening comprises a sealing section which the at least one closure surface contacts, particularly to seal the first and/or second chamber opening in substantially completely gas-tight manner in at least one position of the closure element.

9. The pipetting apparatus according to claim 1, wherein the valve chamber or the closure element comprises at least one sealing section in order to seal the valve chamber in substantially completely gas-tight manner in at least one position of the closure element and/or during the movement.

10. The pipetting apparatus according to claim 1, comprising a first valve device having a first valve chamber and a second valve device having a second valve chamber, wherein the pump device is connected to the first valve chamber in order to generate a first chamber pressure in said first valve chamber and connected to the second valve chamber in order to generate a second chamber pressure in said second valve chamber, wherein the first valve chamber and the second valve chamber are in each case connected to the pipetting channel and the bypass channel, wherein the first valve device is designed such that a suitable pressure is set in the pipetting channel for suctioning a fluid sample into a pipetting container hermetically connected to the pipetting channel, and wherein the second valve device is designed such that a suitable pressure is set in the pipetting channel for dispensing a fluid sample from a pipetting container hermetically connected to the pipetting channel.

11. A method for producing the pipetting apparatus according claim 1, comprising the steps:

producing the at least one valve device of the valve assembly at least partly from a first material;

producing at least one closure element;

producing the at least one pipetting channel, and in particular also the at least one bypass channel, at least partly from a second material.

12. The pipetting apparatus according to claim 2, wherein the closure element comprises a first recess (121; 121*a*; 121*b*; 121*c*; 121*d*) which extends from the closure surface into the depth of the closure element and forms a first closure surface opening in the closure surface, and wherein the closure element comprises a second recess (122; 122*a*; 122*b*; 122*c*; 122*d*) which extends from the closure surface into the depth of the closure element and forms a second closure surface opening in the closure surface, wherein the first closure surface opening lies against the first chamber opening and the second closure surface opening lies against the second chamber opening during the movement.

* * * * *